US007832801B2

(12) United States Patent
Driessen

(10) Patent No.: US 7,832,801 B2
(45) Date of Patent: Nov. 16, 2010

(54) HIGHCHAIR WITH ADJUSTABLE SEAT

(75) Inventor: Franciscus Johannes Cornelis Driessen, Hoge Wal (NL)

(73) Assignee: Mutsy B.V., Goirle (NL)

( * ) Notice: Subject to any disclaimer, the term of this patent is extended or adjusted under 35 U.S.C. 154(b) by 245 days.

(21) Appl. No.: 11/662,884

(22) PCT Filed: Sep. 15, 2005

(86) PCT No.: PCT/NL2005/000675

§ 371 (c)(1),
(2), (4) Date: Sep. 11, 2008

(87) PCT Pub. No.: WO2006/031112

PCT Pub. Date: Mar. 23, 2006

(65) Prior Publication Data

US 2009/0026823 A1 Jan. 29, 2009

(30) Foreign Application Priority Data

Sep. 16, 2004 (NL) ..... 1027056

(51) Int. Cl.
*A47C 1/00* (2006.01)
*A47C 1/08* (2006.01)

(52) U.S. Cl. ..... 297/344.18; 297/344.14; 297/153

(58) Field of Classification Search ..... 297/344.14, 297/344.18, 153
See application file for complete search history.

(56) References Cited

U.S. PATENT DOCUMENTS 2,637,371 A * 5/1953 Boutin ..... 297/294
3,542,419 A 11/1970 Spinola
D261,579 S * 11/1981 Heritage ..... D6/341
4,723,813 A * 2/1988 Kassai ..... 297/153
D337,665 S * 7/1993 Tsuchiya ..... D6/339
5,348,374 A * 9/1994 Kuo ..... 297/344.18
5,468,051 A * 11/1995 Huang ..... 297/344.18
5,489,138 A * 2/1996 Mariol et al. ..... 297/151
5,509,719 A * 4/1996 Cone, II ..... 297/344.18
5,558,400 A * 9/1996 Poulson et al. ..... 297/344.18
5,810,432 A * 9/1998 Haut et al. ..... 297/153
D454,007 S * 3/2002 Huang ..... D6/339
D594,667 S * 6/2009 Wang ..... D6/339

FOREIGN PATENT DOCUMENTS

DE 91 00 772 U1 4/1991
DE 203 070 043 U1 9/2003

* cited by examiner

*Primary Examiner*—David Dunn
*Assistant Examiner*—Erika Garrett
(74) *Attorney, Agent, or Firm*—Harness, Dickey & Pierce, P.L.C.

(57) ABSTRACT

An embodiment of the present invention discloses a highchair with adjustable seat, including a frame and support device, which are connected to the frame and which form a bearing plane for supporting the frame on a floor. The frame includes at least two substantially parallel uprights which in a position of use of the chair protrude at least partly obliquely above the bearing plane. Further, the highchair includes a part adjustable along the uprights, which is provided with an engaging device for engaging the two uprights, wherein the engaging device includes at least one receiving chamber for engaging part of the way round the upright.

17 Claims, 6 Drawing Sheets

HIGHCHAIR WITH ADJUSTABLE SEAT

The invention relates to a highchair with adjustable seat comprising a frame, support means which are connected to the frame and which form a bearing plane for supporting the frame on a floor, and a seat part. From U.S. Pat. No. 4,109,961 is known a chair with an adjustable footrest and an adjustable seat. This chair is made of wood and has two parallel upright parts in which grooves are made in which plate-like parts for seat and footrest can be received such that a person can sit thereon and can optionally support the feet.

A problem of the known chair with adjustable seat is the high weight of this chair. The object of the invention is to provide a highchair with adjustable seat wherein less material is used, for the purpose of reducing the weight. According to a second aspect, it is an object of the invention to reduce costs.

This object is achieved according to the invention in that the frame comprises at least two substantially parallel uprights which in a position of use of the chair protrude at least partly obliquely above the bearing plane, and wherein the highchair further comprises a part adjustable along the uprights, such as a seat part, which is provided with engaging means for engaging the two uprights, wherein the engaging means has at least one receiving chamber for engaging part of the way round the upright. The upright is engaged such that a movement of the upright in the direction of the line of the engaging means/adjustable part is blocked. The seat part itself becomes a part of the frame and contributes toward the rigidity of this frame. The uprights are positioned and held relative to each other by the specific engagement. This in contrast to the stated prior art wherein the seat is arranged loosely between the upright parts of this chair. The receiving chamber can be partly open. The upright can be placed in the receiving chamber via the open side of the chamber. The opening of the receiving chamber will run substantially parallel to the upright, substantially at right angles to the plane of the adjustable part, often a plane parallel to the bearing plane. The uprights run partly at an angle above the bearing plane. The bearing plane runs partly parallel to the ground surface on which the chair is placed. This will often be a horizontal surface. However, where a ground surface bulges the bearing plane will not be the same as the ground surface.

According to a preferred embodiment, the engaging means has an opening for receiving the upright. Because the upright is engaged in enclosed manner, the uprights are positioned relative to each other by means of the seat part. The opening is a particular form of a receiving chamber according to the invention, i.e. a closed chamber. Because the chamber is closed, the upright cannot be released.

According to a preferred embodiment, the two uprights together form part of a substantially U-shaped tube. The two uprights can hereby be manufactured from one basic material, such as a tube. According to the preferred embodiment, the uprights are formed by bending a metal tube, such as a steel tube, into a U-shape. The upright parts of the highchair to which the seat parts must be attached are hereby formed from one basic material. The respective parts, such as a seat or a backrest, can be connected to the U-shaped part. The backrest is preferably arranged on the inner side of a base of the U-shaped part.

In a further preferred embodiment, the support means comprise tubular parts which are preferably provided with support points. The same material can hereby be used for the support means. The support points can be arranged at different positions along the tubular parts, for instance in the form of studs.

The support means preferably comprise a U-shaped tube. For the purpose of forming the support means use can hereby be made of the same manufacturing method as for the uprights for the upright parts of the frame.

In the preferred embodiment, the two substantially U-shaped parts for support means and upright parts of the frame are mutually connected at the outer ends of the legs. An exceptionally simple frame is hereby obtained, wherein the adjustable parts such as the seat part are used as additional strengthening means for positioning the parallel upright parts at a mutual distance.

In the preferred embodiment, the outer ends of the uprights forming the two parallel uprights form part of the support means. A weight arranged on the frame, in particular on the seat part, will hereby be transmitted directly to the support means via the uprights. According to this embodiment a V-shaped frame is obtained wherein one leg of the V-shape forms part of the support means which form the bearing plane for supporting on a floor, and wherein the other leg is the part of the frame positioned standing from the support means which forms the parallel uprights for engagement by the adjustable part.

The parallel uprights preferably each have an adjusting part, wherein the upright is substantially straight over a length of at least 10 cm and the uprights run parallel relative to each other. The adjustable part, such as the seat part, can engage on this adjusting part, and a highchair with adjustable seat is thus obtained wherein the position of the seat can be displaced at least 10 cm.

According to a further embodiment, the adjusting parts extend substantially obliquely above the support means. A chair is hereby obtained having substantially a V-shape, wherein the support means form the one leg of the V-shape and the adjusting parts form the second leg of the V. By adjusting the seat along the adjusting part, for instance an adjustment for a larger child, the seat part will be displaced obliquely downward along the adjusting part, whereby the centre of gravity of the user of the chair is not only moved toward the support means, but also displaces relative to the support means. Particular account is hereby taken of the fact that the user of the chair, as his/her height increases, will also develop longer legs, whereby the distance between backrest and seat can be increased.

The recess of the engaging means is preferably placed at an angle relative to a seat surface of the seat part, this angle being substantially equal to the angle of the uprights relative to the bearing plane. A Z-figure is hereby substantially created between the bearing plane, the uprights and the seat part. The seat part will thus be placed substantially horizontally when the bearing plane is horizontal.

The highchair further preferably comprises a bumper, preferably a table part or dinner tray, which is provided with engaging means for engaging the two uprights, wherein the engaging means have at least one opening for receiving the upright. The use of a table part/bumper prevents the child being able to leave the seat. In addition, this adjustable part also has an additional rigidity function for the frame. By making use of two adjustable parts, the uprights of the frame are now positioned at two locations relative to each other.

The table part/the bumper preferably comprises a crotch bar extending from the bumper/table part to the adjustable seat part, which crotch bar has an adjustable length. The crotch bar engages on the seat part, preferably via a bayonet fitting. Arranged in the seat part is a recess for engagement of the crotch bar on the seat part. Due to the adjustable length it is possible to take into account different distances between bumper and seat.

The engaging means for engaging the uprights preferably comprise a protruding, movable, preferably slidable part which is preferably biased by spring means, which protruding part can be received in recesses arranged in the uprights. By means of a control the protruding part can be retracted and the adjustable part can be unlocked and adjusted.

The support means can be provided with a soft material, whereby damage to the ground surface is prevented during displacement of the chair over the ground surface.

The U-shaped parts of the support means and the upright parts of the frame are preferably connected to each other at an angle, preferably an angle between 20° and 70°, and in a further preferred embodiment between 30° and 60°. A V-shaped frame is hereby obtained. The connection of the support means to the upright parts of the frame of the chair is preferably somewhat resilient. A pleasant effect can hereby be achieved for the user of the chair. This is particularly favourable when the chair is used for children.

The adjustable parts form modular parts for the chair. Examples are the seat, the crotch bar, the table and a footrest. All parts further strengthen the frame due to the engaging means with recess.

The two recesses and the possibility of tilting the adjustable part, wherein the uprights are transferred from a first recess to a larger, second recess in the engaging means, create at least two positions of use, a first position of use in which the adjustable part is clamped around the upright and a second position in which the adjustable part is slidable along the upright of the chair.

In one embodiment the adjustable parts are continuously adjustable along the uprights/tubes of the frame, for instance through a clamping engagement. The engaging means are preferably fixing means, the position of which can be secured. The fixing part is formed from plastic, for instance by injection moulding. In the preferred embodiment, two recesses are arranged with two axes at a mutual angle in one engaging means for one upright. The one recess is larger than the other recess. The smaller recess is substantially equal to or slightly smaller than the diameter of the tube of the frame. From this clamping position the engaging means can be tilted counter to a resistance such that the tubes of the frame spring from the one recess to the other recess, i.e. from a smaller to a larger recess. The upright which is received in the larger recess can be readily displaced to a new position. At the desired location the adjustable part can be tilted back and secured on the tubes of the frame. By enclosing engagements the tubes of the frame are positioned relative to each other by means of the support means, in particular the footrest.

The adjustable parts, in particular the seat part and the footrest, preferably take a rigid form, and the uprights can be received in the recess on the engaging means at outer ends on either side of the adjustable parts.

In another embodiment the engaging means can for instance be formed by two plastic parts which are joined together, wherein the upright is enclosed between the joined parts which form a recess.

In another embodiment, the frame of the chair can be engaged in a different manner. A hooking fastening is particularly possible here.

According to an embodiment the engaging/fixing means of the seat surface on the frame engages clampingly on the frame. In one embodiment the fixing means comprises a handle provided with a pin which can engage in position holes in the frame, in particular in the upright. Using the handle the seat surface can be fastened at the desired position. Arranged in the upright tube at desired distances are holes in which the pin can engage so that the seat surface can be fastened. The handle is connected pivotally to the seat surface and can be operated.

The control, in this case the handles, is preferably arranged on the underside of the seat surface, whereby they are less easily accessible to the user, in particular to the child using the chair. In the other embodiment the mounting takes a continuous form.

The bumper bar is preferably formed by a curved tube which is provided on the outer ends of support means, in particular engaging means for the uprights, wherein a crotch bar is arranged substantially in the middle of the curved tube. Arranged on the free end of the crotch bar is a fixing means, for instance provided with pins, which means can co-act with the recesses in the (adjustable) seat surface. A rigid connection between the crotch bar, and therewith the bumper bar, can hereby be obtained relative to the seat surface.

According to another embodiment, the chair according to the invention comprises a dinner tray. This is also an additional strengthening means for the frame. The dinner tray is provided with a crotch bar. The crotch bar can be connected to the seat surface.

The dinner tray is preferably provided with engaging means which engage on the frame. The fixing means preferably engage on the bulge with which the backrest tube is fastened to the frame. The fixing means of the dinner tray is preferably formed by a clamping means which preferably consists of two parts connected hingedly to each other. The first part is fixedly connected to an arm of the dinner tray. The second part is connected hingedly to the first part and provided with a protrusion which can engage in a recess on the frame, in particular a recess arranged on the outside of the fixing means of the backrest on the frame. This can be the recess in the longitudinal direction of the fixing means of the backrest on the frame substantially parallel to the tube received therein. The tube and/or protrusion are hereby clampingly engaged.

The invention also relates to a specific tube for a frame of a highchair, in particular an adjustable highchair. According to the invention the tube has a substantially circular cross-section. The tube also has a recess or ridge arranged in the outer periphery. In the ridge can be received an outer periphery of a support part of the highchair, such as for instance a seat part or a backrest part, in particular plastic support parts. The outer periphery can be partly received by the recess and is partly concealed. The outer periphery of the plastic parts is sharp and can result in accidents or injuries. Parts of the peripheral edge of the support part can also be received in an auxiliary part arranged on the inner side of a tube of the frame, wherein the auxiliary part has a contact surface for the seat part.

The invention will be further described with reference to the annexed drawings, in which.

Figures 1, 2, 3:
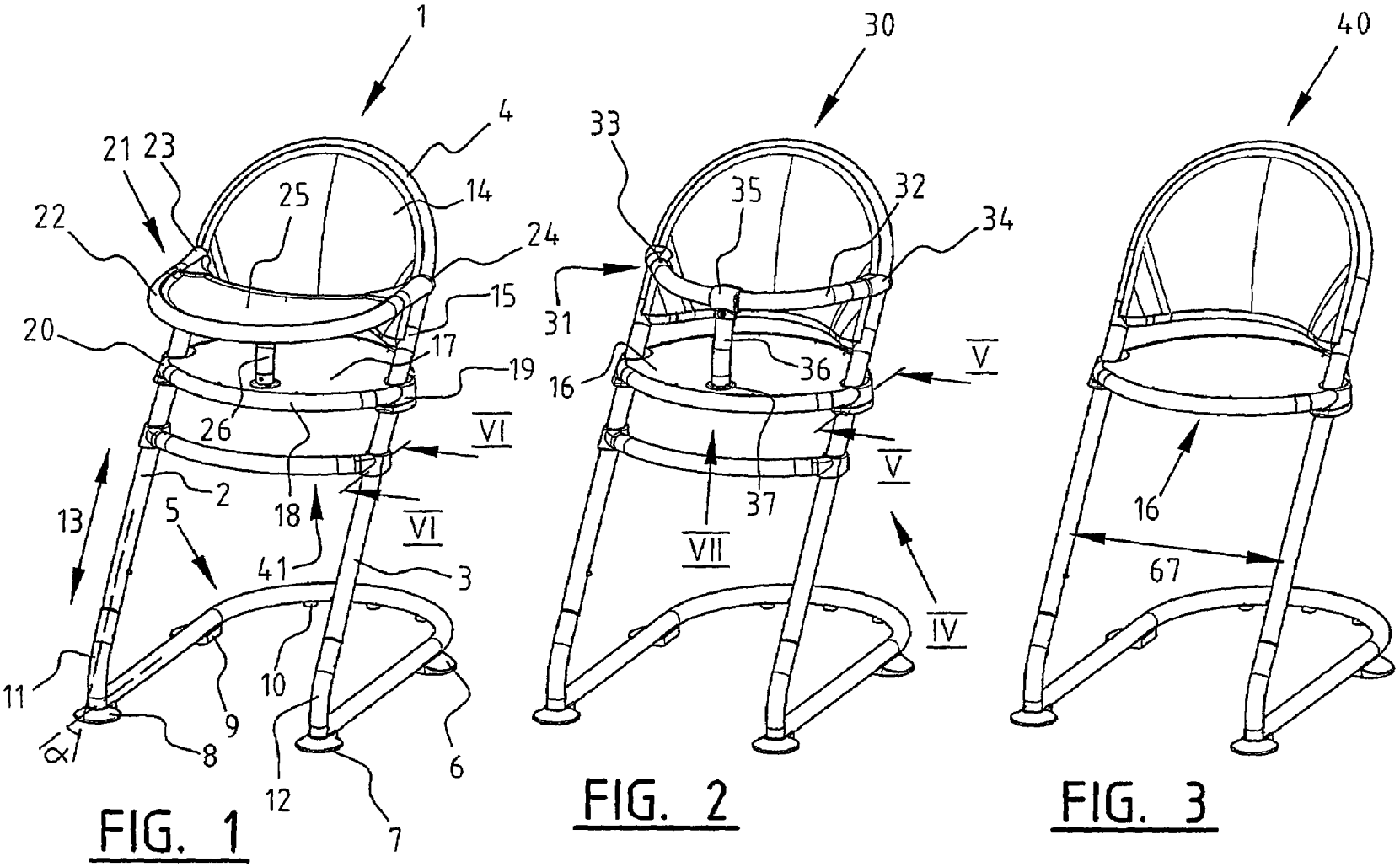
FIG. 1 is a perspective view of a first embodiment.
FIG. 2 is a perspective view of a second embodiment.
FIG. 3 is a perspective view of a third embodiment.
Figures 4, 5, 6:
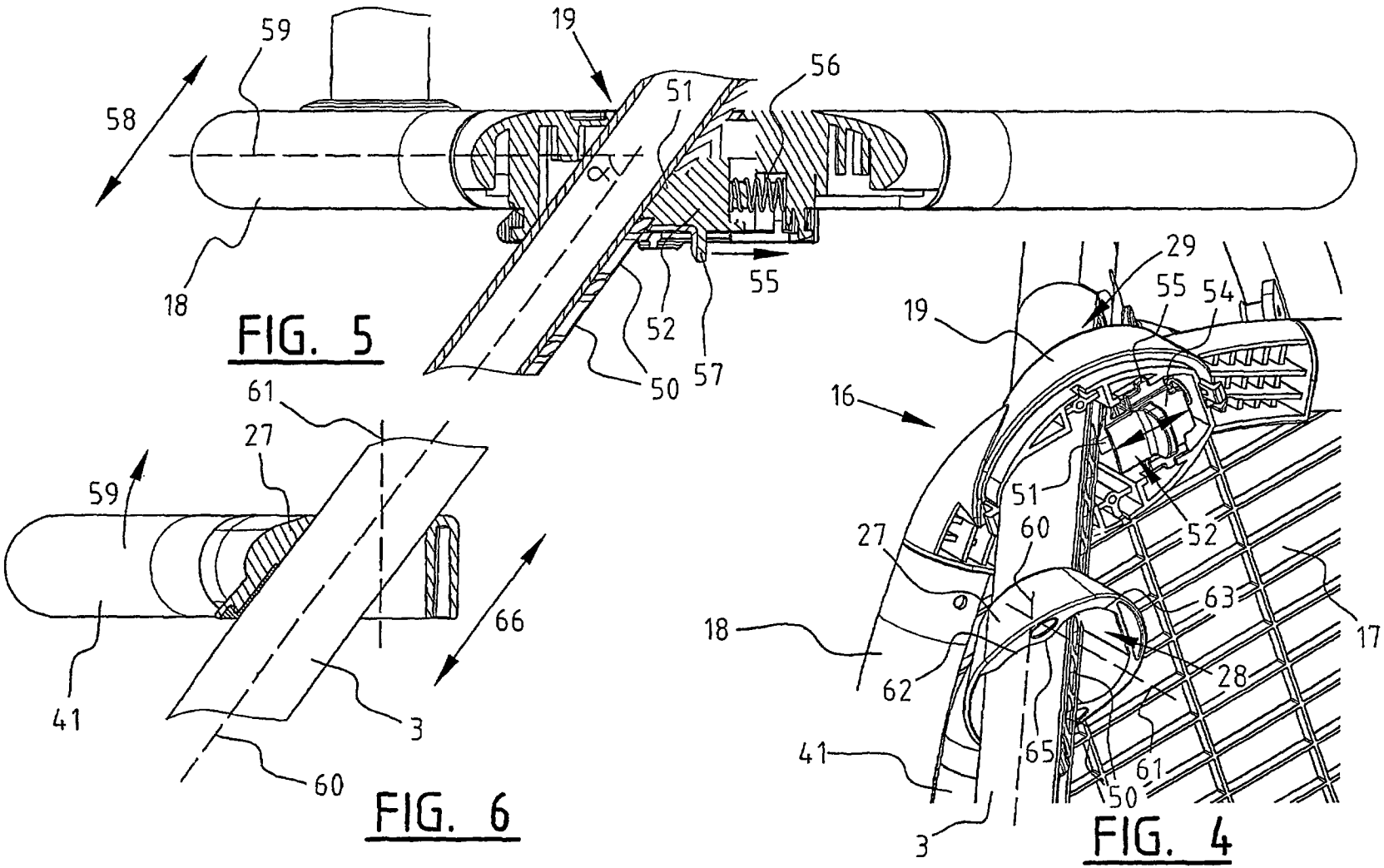
Figure 8:
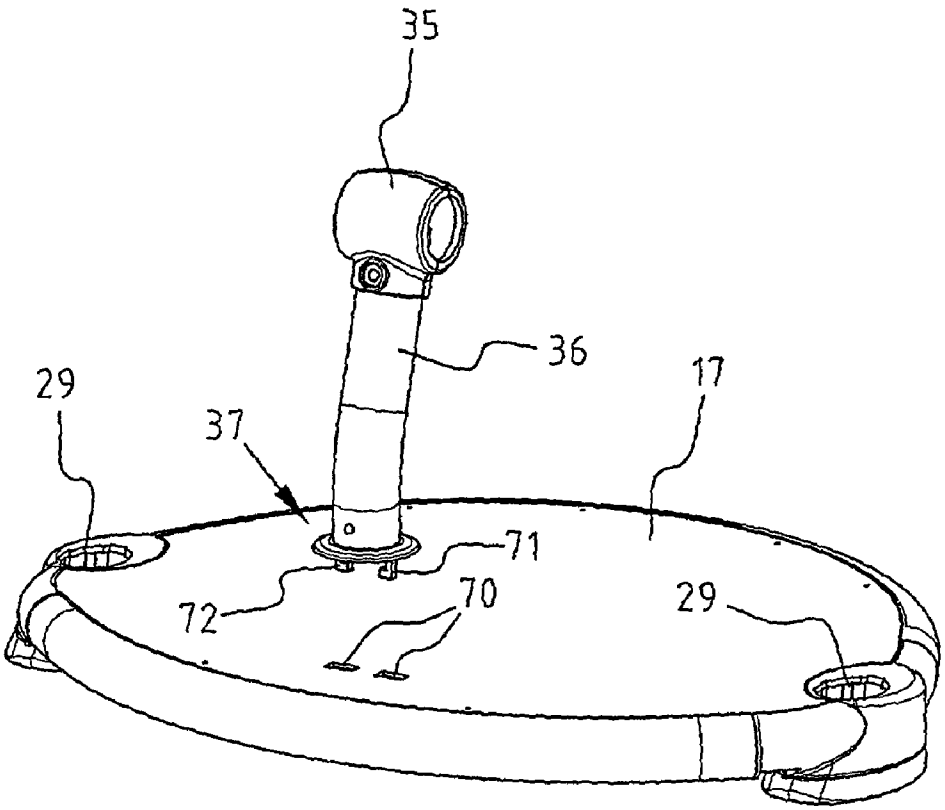
Figure 7:
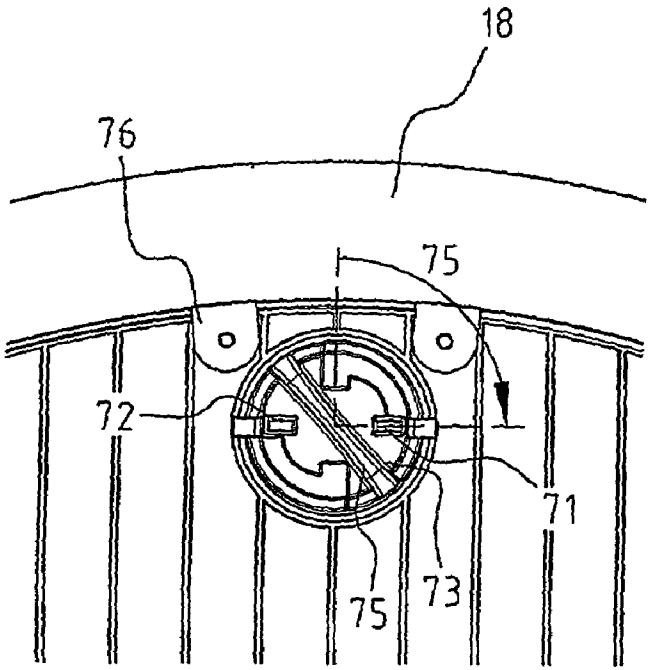
Figures 9A, 9B, 9C:
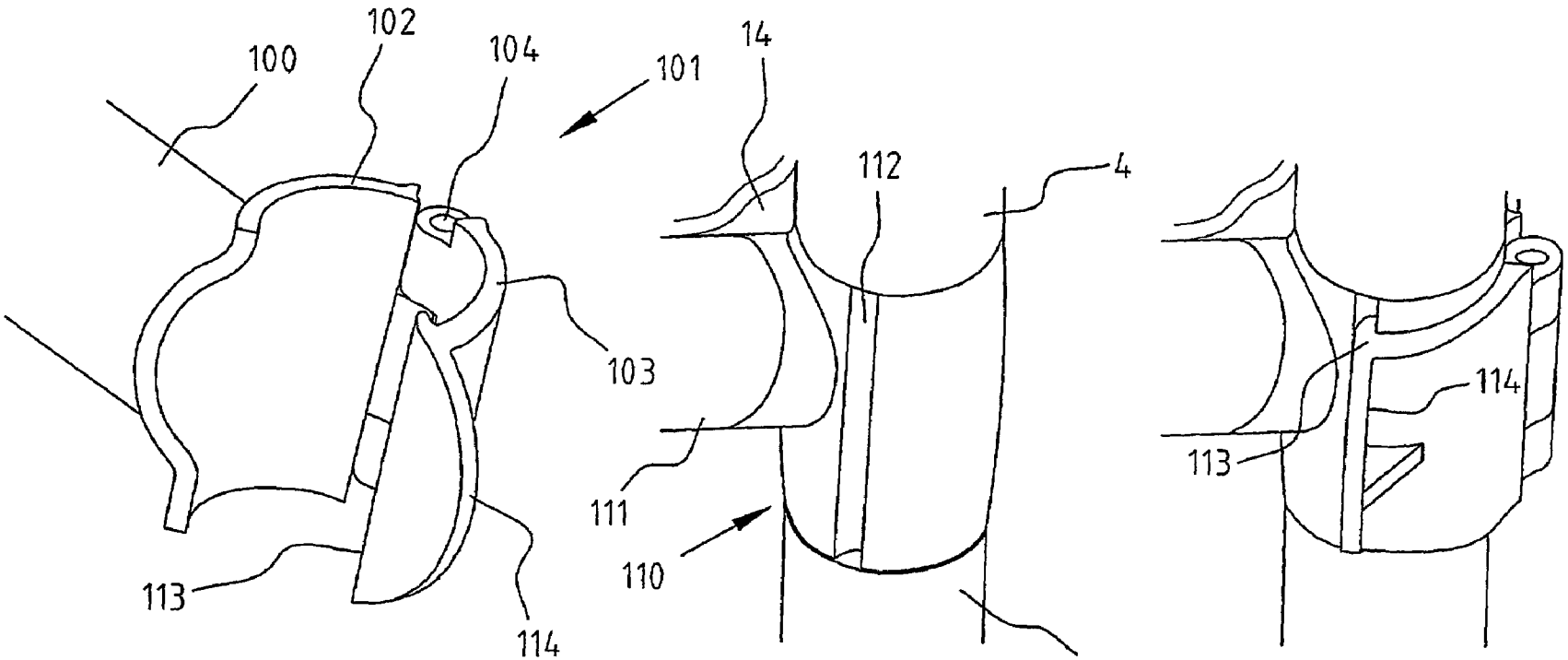
Figure 10:
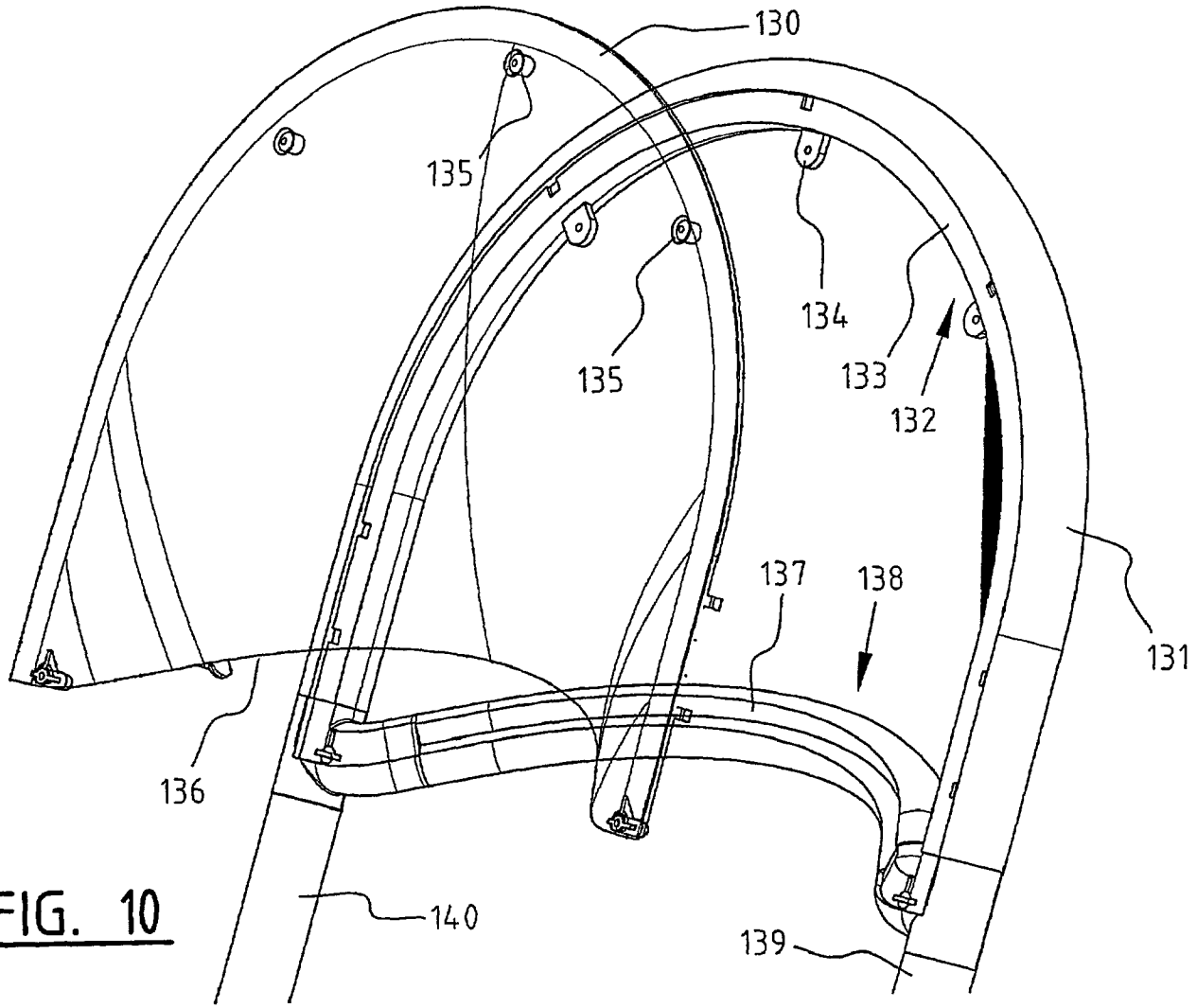
Figure 11:
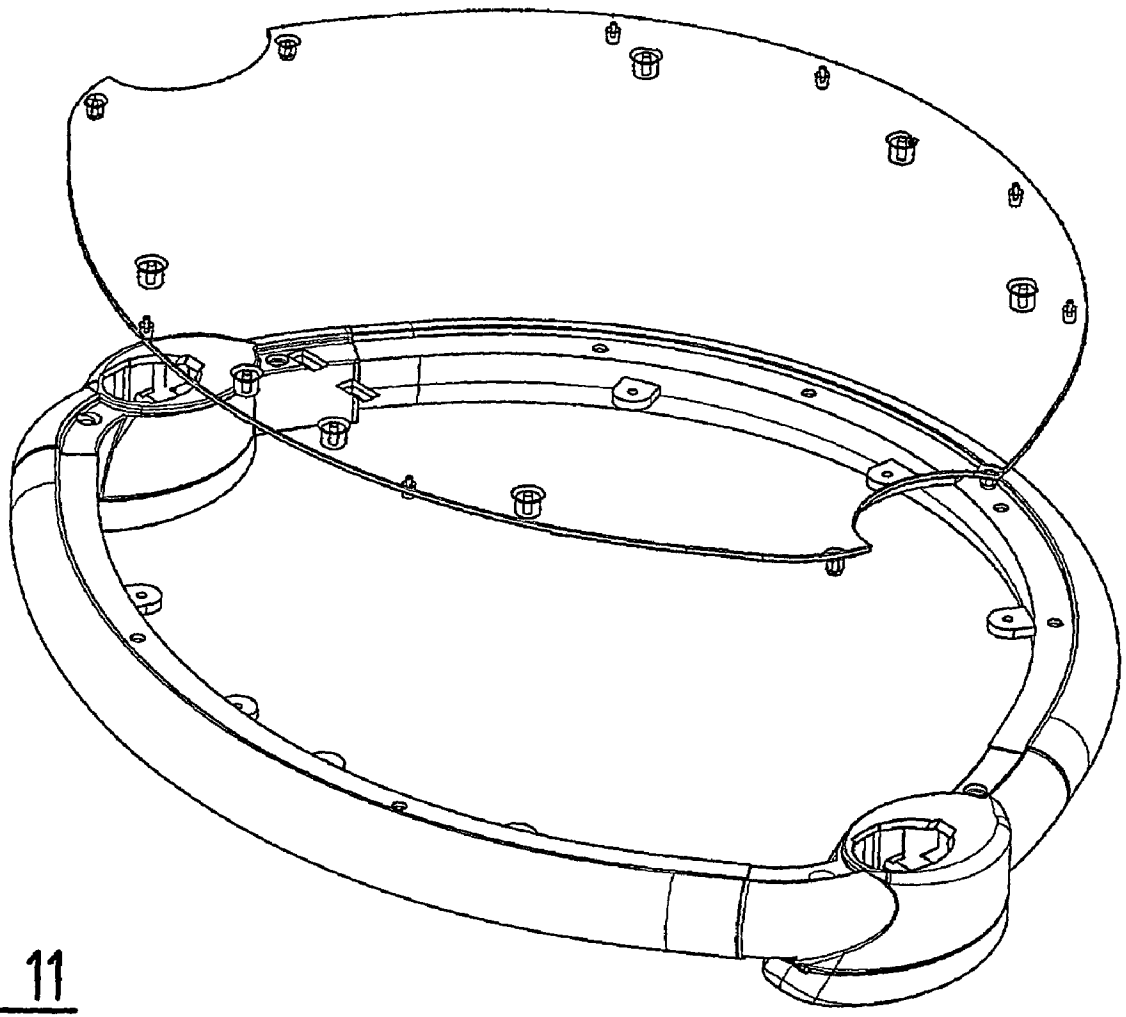

FIG. 4 is a perspective view of a detail as according to arrow IV in FIG. 2, FIG. 5 is a cross-section along the line V-V in FIG. 2, FIG. 6 is a cross-section along line VI-VI in FIG. 1, FIG. 7 is a view of a detail as according to arrow VII in FIG. 2, FIG. 8 is a perspective view of the seat and crotch bar according to another embodiment, FIG. 9A shows a detail of another embodiment of the engaging means of a dinner tray, FIGS. 9B and 9C show a detail of the engaging means of the backrest, and FIG. 10 shows a detail of a backrest and tube for a frame according to the invention, FIG. 11 shows a detail of an adjustable seat part.

FIG. 1 shows the highchair with adjustable seat 1 according to a first embodiment. The chair consists of a number of frame parts, including first parallel upright 2, second parallel upright 3 which are mutually connected via U-shaped part 4. Uprights 2, 3 and connecting part 4 are formed from a single tube, which is curved.

The frame further comprises support means 5 formed by a U-shaped tube provided with a number of support points 6, 7, 8, 9 and 10, formed by studs which support on a floor (not shown) in the position of use. FIG. 1 shows the highchair in the position of use on a floor (not shown).

The outer ends of uprights 2 and 3 are formed by a curved piece 11, 12 which, in the shown embodiment, is a tube part coupled to U-shaped part 2, 3, 4. The curved parts 11, 12 are releasably connected to a tube end of uprights 2, 3, and studs 8 and 7 are connected to the other outer end of tube parts 11, 12. A weight present on uprights 2, 3 will press directly onto studs 7, 8.

Uprights 2, 3 form an angle $\alpha$ with the bearing plane of support means 5. Curved parts 11, 12 are curved around substantially the same angle U. The tubular part 2, 3, 4 protrudes obliquely above support means 5 in the position of use as shown in FIG. 1. The angle $\alpha$ preferably lies between 20° and 70°, and in the shown embodiment is roughly equal to 45°.

Uprights 2 and 3 have an adjusting part which extends through a length indicated by arrow 13. This part of uprights 2 and 3 is substantially straight and the two uprights run parallel here.

On the inner side of U-shaped part 2, 3, 4 of the obliquely extending frame part the frame is further provided with a backrest part 14, which is for instance formed by a plastic. The backrest part is nail-shaped. The backrest part is provided with a receiving edge along a periphery in which tube part 4 can be received, and is provided with engaging means 15 which engage on uprights 2 and 3. Engaging means 15 can be clamping or engage on a recess in upright 3.

Highchair 1 is further provided with adjustable parts 16 and 17, respectively a seat part and a footrest. Seat part 16 will be shown in more detail in FIGS. 4, 5 and 7. The footrest is shown in more detail in FIG. 6.

Seat part 16 has a seat surface 17 and a curved tube 18 wherein engaging means 19 and 20 are arranged on the outer ends. Engaging means 19 and 20 engage on uprights 3 and 2 and are displaceable over the adjusting part indicated with arrow 13. The engaging means is shown in more detail in FIG. 5. The engaging means is provided with a recess through which uprights 2 and 3 protrude.

A dinner tray 21 is also shown, which is formed by a tube 22, engaging means 23, 24 which are arranged on the outer ends of the tube and which engage on tube part 4 of the frame, and a table top 25 which is clamped on the inner side of U-shaped tube 22 and between engaging means 23 and 24. Connected to the dinner tray is a crotch bar 26 which is arranged on the underside of the dinner tray and which protrudes into a recess of seat 17. This connection is shown in FIG. 7.

In the shown embodiment engaging means 23, 24 are comparable to the engaging means of the seat. They engage on a part of tube 2, 3, 4. A recess, in which the engaging means engage, can be arranged in the tube at the appropriate position. In another embodiment the engaging means 23, 24 engage on clamping means 15 of the backrest. This is shown in FIGS. 9A, 9B and 9C.

FIG. 2 shows another embodiment of highchair 30, wherein dinner tray 21 is replaced by a bumper bar 31 consisting of a curved tube 32 provided on the ends with clamping means 33, 34 and provided in the middle with a connecting piece 35 which connects the curved tube 32 to a crotch bar 36 which engages on seat 16 by means of engaging means 37.

FIG. 3 shows a third embodiment of a highchair 40 with adjustable seat 16. The frame is formed by two U-shaped parts consisting of tubes, wherein the U-shaped parts are mutually connected at the tube ends, whereby in side view a V-shaped highchair is obtained.

FIG. 4 shows a view as according to arrow IV in FIG. 3. The underside of seat 17 is shown. Also shown is upright 3, on which is fixed the engaging means 27 fixed to an outer end of foot-rest 17. Also shown from the underside on the adjusting part of upright 3 is engaging means 19 of seat 16, wherein the relevant clamping and fixing means are made visible on upright 3.

Upright 3 is received in a recess 28 of engaging means 27 and recess 29 of engaging means 19.

Upright 3 has a partly round periphery. On the rear side (if FIGS. 1 and 2 are designated as front views) upright 3 is flattened and provided with a number of recesses 50. In the recesses can be received a protruding means of an engaging means, whereby fixing of one of the adjustable parts to the upright becomes possible. In the shown embodiment according to FIG. 4, the engaging means 19 is a protruding part 51 which forms part of the controllable element 52, which can be moved as according to arrow 54 by means of guide means accommodated in engaging means 19. Shown are the protrusions 55 of the guide means of part 51 which act in the direction of arrow 54. In the position of use shown in FIGS. 1 and 2 the controllable catch 52 is situated on the underside of engaging means 19, so that a child making use of highchair 1 or 30 cannot readily reach this controllable element 52, whereby the seat could be released. FIG. 5 shows a cross-section of the controllable element. By means of a spring tensioning, in the shown embodiment a spiral spring 56, the controllable block 52 is biased in the direction of recesses 50 in the upright. When the user engages protrusion 57 and moves it as according to arrow 55, protruding part 51 will be movable out of the recess and the upright can be moved as according to arrow 58, i.e. along upright 3.

FIG. 5 also shows that the plane of the seat indicated with 59 forms an angle $\alpha$ with upright 3, which angle $\alpha$ is the same as the angle $\alpha$ in FIG. 1. The seat in fact forms a Z-shaped figure with upright 3 and the support means forming a bearing plane. A seat surface is hereby created which runs substantially parallel to the bearing plane of the support means. When the chair is placed on a horizontal surface, the seat is also placed horizontally.

The engaging part 19 is formed by injection moulding.

FIG. 4 also shows the engaging means 27 provided with two recesses. The axes 60 and 61 of the two recesses are indicated. Axis 60 is associated with a recess, a part of the peripheral edge 62 of which is visible, and axis 61 is associated with a recess, a part of the peripheral edge 63 of which is visible. Peripheral edge 62 has a smaller diameter than peripheral edge 63. Because upright 3 is not wholly round, peripheral edge 63 is not wholly round either.

FIG. 6 shows engaging means 27 in cross-section. In the shown position according to FIGS. 4 and 6, the upright is engaged clampingly by peripheral edge 62 of the first recess. Footrest 17 is thus fixed clampingly to upright 3. For upward tilting of footrest 17 as according to arrow 64, a resistance caused by the clamping protrusions 65 of the engaging means must be overcome, and once it has been overcome the upright will be received in the recess with axis 61. This recess has a larger diameter and the upright is not engaged clampingly.

The upright can now be adjusted along the upright as according to arrow 66 and carried to a new position. This adjustment is continuous. When the new position has been reached, the footrest is tilted back to a substantially horizontal position at which the upright is once again received in the recess with first axis 60. The footrest is now connected clampingly to the upright again and cannot be moved. The footrest can serve as support for the feet of a child.

Both the dinner tray and the seat and the footrest, as well as the bumper bar, have a number of rigid components which ensure that the engaging means at the respective outer ends engaging on the uprights have in each case a fixed mutual distance. The respective recess of the engaging means on either side of the adjustable parts have an axis which lie a distance 67 apart in each case. This ensures that, using a randomly adjustable part, the distance between upright parts 2 and 3 is equal to substantially this distance 67 in each case. The adjustable parts thus form an additional part of the frame which ensures the mutual position of the uprights relative to each other. The highchair according to the invention can hereby be assembled with very simple means and additional rigidity is obtained by positioning the adjustable parts. The highchair according to the invention therefore has at least one adjustable part.

FIG. 7 shows a detail according to arrow VII of an underside of seat 17. FIG. 8 shows a perspective view of seat 17. Close to the centre of the seat there are arranged two recesses 70 in seat 17, through which pass the protruding parts 71, 72 formed by hooking parts of crotch bar 36. The hooking elements 71, 72 can be inserted in recess 70, and herein protrude beyond the underside of seat 17. On the underside is arranged a rotatable locking disc 73 which is rotatable as according to arrow 74. In the opened position the hooks 71, 72 can be arranged through recess 70, and disc 73 can then be rotated by means of the grippable protrusion 75 to a position as shown in FIG. 7, wherein hooks 71 and 72 engage over the disc and are not released.

FIG. 7 also shows the connection of curved tube 18 to seat 17 by means of connecting elements 76.

FIG. 9A shows another embodiment of the engaging means for the uprights, in this case the engaging means of the dinner tray. Arranged on the outer end of a tube 100 is engaging means 100, which consists of two parts 102, 103, wherein second part 103 is connected pivotally on a shaft 104 to first part 102. Both parts can be obtained by injection moulding. FIG. 9B shows the fastening of backrest 14 to a component of tube 3, 4. The shown engaging means 110 differs from the engaging means shown in FIG. 1. The engaging means is connected clampingly to tubes 3, 4, optionally in screwed manner. The fastening is thus fixed. Engaging means 110 is provided with a receiving space for tube 111 of the backrest.

Engaging means 110 is also provided with a groove 112 which extends substantially in a longitudinal direction parallel to the tube. The protrusion 113 of the second hinging part 103 can be received in groove 112 as shown in FIG. 9C. With the operating means 114 the protrusion can be positioned in groove 112 and engaging means 101 engages on clamping means 110 of the backrest.

In one embodiment clamping means 110 is placed between upright 3 and U-shaped part 4.

FIG. 10 shows a support part 130 for a chair or highchair. This relates to the backrest. The backrest is formed as nail-shaped part and is enclosed in and between the U-shaped base of frame 131. On the inner periphery of frame 131 is arranged an auxiliary part 132 of plastic, which is provided with a contact surface 133 and fastening points 134. The contact surface connects to the outer periphery of backrest 130, while the fastening points can be connected to the corresponding parts 135 on the backrest using fastening means such as screws.

Peripheral edge 136 is received in ridge or recess 137 of tube 138, which tube connects the two uprights 139, 140 of the frame to each other. Engaging means for the uprights are arranged on the outer ends of tube 138. The tube has a circular cross-section but is also provided over its length with a ridge in which edge 136 can be received. A substantially smooth connection of edge 136 on ridge 138 is hereby obtained. Due to the ridge it is not necessary for edge 136 to take an obliquely sloping form.

FIG. 11 shows a comparable detail of the adjustable seat part. The tube here also has a substantially circular cross-section. A ridge is arranged in the tube. The peripheral edge is received in the ridge.

The invention is described on the basis of a number of embodiments. It is noted that different combinations of a number of the stated measures are suitable for a divisional application. The subject of the divisional application is not limited to those components of which advantages are stated here in the above description, but can also relate to measures stated above, the advantages of which have been omitted for the sake of a concise description.

The invention claimed is:

1. Highchair with adjustable seat, comprising:

a frame;

support members, connected to the frame and forming a bearing plane, for supporting the frame on a floor, the frame including at least two substantially parallel uprights which, in a position of use of the chair, protrude at least partly obliquely above the bearing plane; and a seat part, adjustable along the uprights, with the seat part including engaging members for engaging the two uprights, wherein the engaging members include at least one recess for receiving one of the uprights and for engaging part of the way round one of the uprights, wherein the two uprights together form part of a substantially U-shaped upright, and wherein an outer periphery of a backrest engages an inner periphery of a U-shaped base of the frame at an end away from the bearing plane.

2. Highchair as claimed in claim 1, wherein the uprights are formed by a steel tube curved in a U-shape.

3. Highchair as claimed in claim 2, wherein the backrest has a receiving edge along a periphery in which a tube part of the upright can be received.

4. Highchair as claimed in claim 1, wherein the support members are formed by tubular parts.

5. Highchair as claimed in claim 4, wherein the tubular part is provided with support points.

6. Highchair as claimed in claim 4, wherein the support members comprise a U-shaped tube.

7. Highchair as claimed in claim 6, wherein the frame is formed by two substantially U-shaped parts, said parts being mutually connected at outer ends thereof.

8. Highchair as claimed in claim 1, wherein outer ends of the two parallel uprights form part of the support members.

9. Highchair as claimed in claim 1, wherein the parallel uprights each have an adjusting part, wherein the upright is substantially straight over a length of at least 10 cm and the uprights run parallel relative to each other.

10. Highchair as claimed in claim 9, wherein the adjusting parts extend obliquely above the support members.

11. Highchair as claimed in claim 1, wherein the recess of the engaging members are placed at an angle relative to a seat surface of the seat part, this angle substantially corresponding to the angle of the upright relative to the bearing plane.

12. Highchair as claimed in claim 1, wherein the chair also comprises a table part provided with engaging members for engaging the two uprights, wherein the engaging members have at least one opening for receiving the upright.

13. Highchair as claimed in claim 1, wherein an outermost periphery of the backrest is enclosed in and between the U-shaped base of the frame at the end away from the bearing plane.

14. Highchair as claimed in claim 13, wherein the U-shaped base of the frame at the end away from the bearing plane includes a U-shaped contact surface and the backrest includes a U-shaped outer periphery configured to contact the U-shaped contact surface.

15. Highchair as claimed in claim 1, further comprising:

a tube connecting the two parallel uprights, wherein a bottom peripheral edge of the backrest contacts the tube and an upper peripheral edge of the backrest contacts the U-shaped base of the frame at the end away from the bearing plane.

16. Highchair as claimed in claim 15, wherein the tube includes a ridge engaging the bottom peripheral edge of the backrest.

17. Highchair as claimed in claim 1, wherein the seat part is movable relative to the backrest.

* * * * *